US005934669A

United States Patent [19]

Uchida et al.

[11] Patent Number: 5,934,669

[45] Date of Patent: Aug. 10, 1999

[54] SORTER HAVING NON-SORTING BIN AND MULTIPLE SORTING BINS, AND SORTING METHOD USED IN SORTER

[75] Inventors: Motonari Uchida; Kazunori Ono, both of Toyokawa, Japan

[73] Assignee: Minolta Co., Ltd., Osaka, Japan

[21] Appl. No.: 08/861,155

[22] Filed: May 21, 1997

[30] Foreign Application Priority Data

May 24, 1996 [JP] Japan ..... 8-130159

[51] Int. Cl.[6] ..... B65H 39/10

[52] U.S. Cl. ..... 271/288; 271/293; 271/294; 271/298; 271/303

[58] Field of Search ..... 271/293, 294, 271/298, 303, 292, 288

[56] References Cited

U.S. PATENT DOCUMENTS 4,709,915 12/1987 Ishikawa et al. ..... 271/288

5,011,130 4/1991 Naito et al. ..... 271/294 X 5,035,412 7/1991 Hiroi et al. ..... 271/294 X

*Primary Examiner*—David H. Bollinger

*Attorney, Agent, or Firm*—Sidley & Austin

[57] ABSTRACT

A sorter includes a non-sorting paper exit, a sorting paper exit, a non-sorting bin and a bin assembly having a plurality of sorting bins. When a non-sorting mode is selected, papers is ejected from the non-sorting exit to the non-sorting bin which faces to the non-sorting exit. When a sorting mode is selected, papers are ejected from the sorting exit to the sorting bins each of which faces to the sorting exit by sequentially shifting the bin assembly. In this operation, the non-sorting bin is kept stationary while the papers are ejected to the upper sorting bins, and the non-sorting bin is shift together with the sorting bins while the paper are ejected to the lower sorting bins.

9 Claims, 4 Drawing Sheets

SORTER HAVING NON-SORTING BIN AND MULTIPLE SORTING BINS, AND SORTING METHOD USED IN SORTER

BACKGROUND OF THE INVENTION

1. Field of the Invention

The present invention pertains to a sorter, and more particularly to a sorter that sorts paper ejected from a copying machine or printer into multiple bins.

2. Description of the Related Art

Various sorters that sort, in page order or by original, paper on which an image has been formed have been developed in recent years as options for image forming apparatuses such as electrophotographic copying machines and laser printers. As sorters of this type, those which move up and down as a single unit multiple sorting bins comprising a bin assembly for the sorting of paper are common.

For example, U.S. Pat. No. 4,709,915 discloses a sorter having a paper exit for non-sorting and a paper exit for sorting, in which the uppermost bin is used as the non-sorting bin and the second and lower bins are used as sorting bins.

In said sorter, however, because the non-sorting bin and sorting bins are moved together as one unit and there are two paper exits, in either sort mode or non-sort mode it is necessary to move the bin to which paper is to be ejected from the standby position to an applicable paper exit before the first sheet on which an image is formed is ejected, and therefore some time is necessary before the first sheet may be ejected. In order to resolve this problem, the non-sorting bin can be fixed to the upper area of the sorter main unit. However, this construction limits the range in which the sorting bins may be moved, such that the number of sorting bins that may be installed is reduced, or such that the non-sorting bin protrudes at the upper area of the sorter main unit, which makes the sorter large in size.

SUMMARY OF THE INVENTION

The object of the present invention is to provide a sorter that can immediately eject the first sheet in either sort mode or non-sort mode and in which the number of sorting bins installed is not limited and the non-sorting bin does not protrude at the upper area of the sorter main unit.

The object of the present invention is attained by means of a sorter equipped with a non-sorting paper exit from which paper is ejected in non-sort mode, a sorting paper exit that is located below said non-sorting paper exit and from which paper is ejected in sort mode, a non-sorting bin that receives paper ejected from said non-sorting paper exit and a bin assembly comprising multiple sorting bins that receive paper ejected from said sorting paper exit, wherein said bin assembly is installed such that each sorting bin may be moved up or down in sort mode to the level at which it faces the sorting paper exit while the level at which the uppermost sorting bin faces the sorting paper exit is the standby position, and wherein said non-sorting bin is installed such that it may be freely moved up or down in the range above its standby position at which it faces said non-sorting paper exit, said non-sorting bin moving up or down together with the movement of said bin assembly in a range above a prescribed level.

In the present invention, the non-sorting bin moves together with the bin assembly when the bin assembly moves up or down in a range above a prescribed level. Therefore, for example, assuming there are 20 sorting bins, after the 13th sorting bin has been moved up to the level at which it faces the sorting paper exit, when the bin assembly moves above said level, or in other words, when paper is ejected into the 14th through 20th sorting bins, the non-sorting bin also moves together with the bin assembly. In comparison with a conventional example in which 20 sorting bins and a non-sorting bin are moved together or in which 20 sorting bins are moved up or down in a range below a fixed non-sorting bin, the height of the sorter main unit may be reduced to the extent of the height of the area needed to install seven sorting bins with which the non-sorting bin moves together in the present invention. Consequently, if the height of the sorter main unit is made the same as in the conventional example, the number of sorting bins installed may be increased to the extent of the range in which the non-sorting bin moves. On the other hand, if the number of sorting bins is made the same as in the conventional example, the height of the sorter main unit may be reduced to the extent of the range in which the non-sorting bin moves, or a useful space in which another device can be placed may be obtained inside the sorter main unit.

Further, said object is preferably attained by means of a sorter with a drive shaft having a spiral groove around its outer surface for the upward and downward movement of the sorting bins, wherein each sorting bin has pins on both sides, each of said pins having a roller at the tip, so that the sorting bins are moved up or down by means of said rollers engaging with said spiral groove of said drive shaft.

Further, said object is preferably attained by a sorter in which each sorting bin has at least two pins on one side and a frame that has two guide grooves, the distance between said guide grooves being smaller than the distance between said two pins.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENT

The sorter pertaining to the present invention is explained below with reference to the accompanying drawings.

Figure 1:
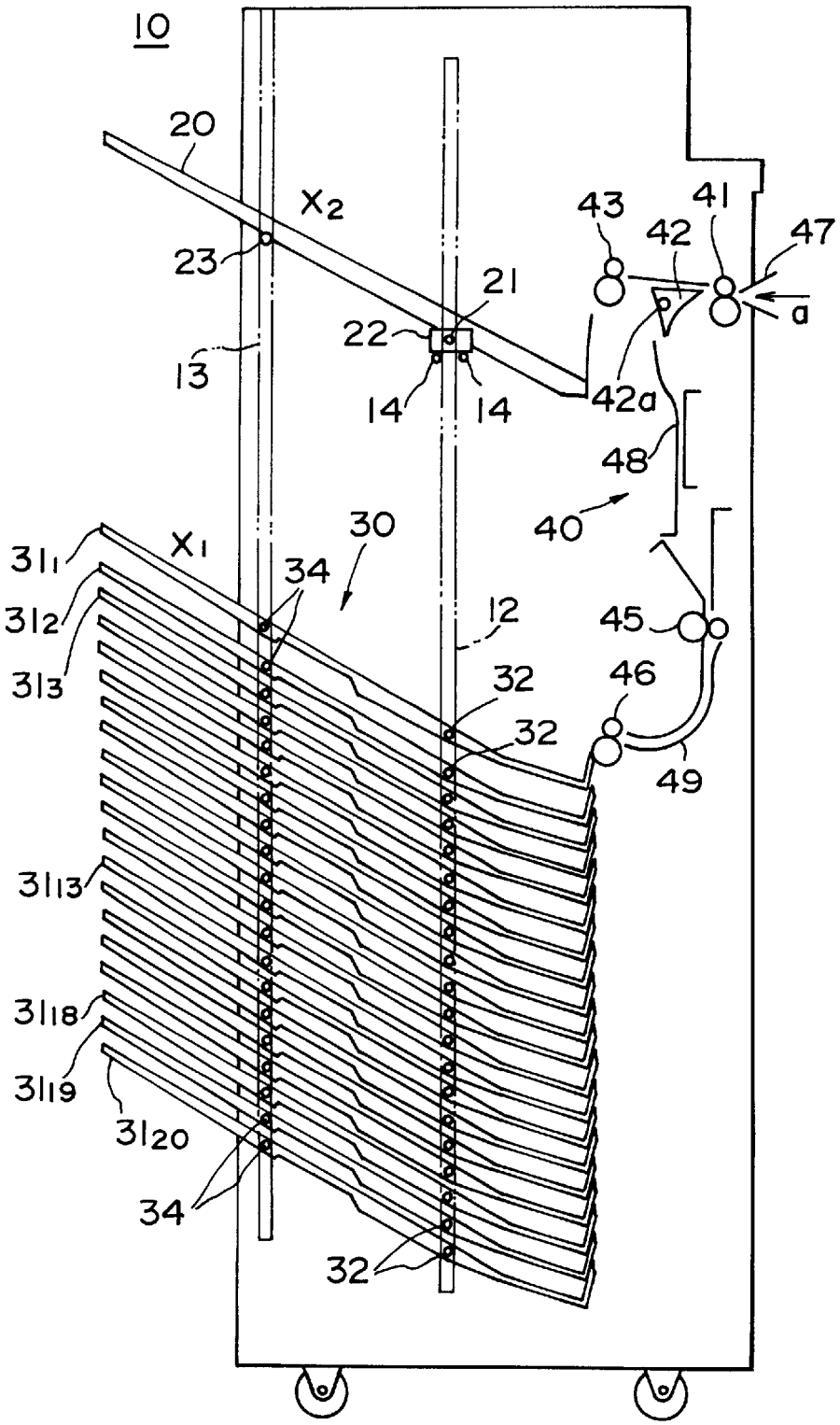
FIG. 1 is a plane view outlining the construction of a sorter, one embodiment of the present invention, in which the non-sorting bin and sorting bins are at the standby positions.

Sorter 10 essentially comprises, as shown in FIG. 1, non-sorting bin 20, bin assembly 30 having 20 sorting bins $\mathbf{31}_1$ through $\mathbf{31}_{20}$ and paper conveyer 40.

Paper conveyer 40 is equipped with a pair of ejection rollers 43 for the non-sorting paper exit and a pair of ejection rollers 46 for the sorting paper exit as well as a pair of receiving rollers 41 that receive paper ejected from the electrophotographic copying machine not shown in the drawing, switching claw 42 that changes the direction of the conveyance of the paper, a pair of conveyor rollers 45, paper guide plates 47, 48 and 49, etc. Switching claw 42 is rotatable with pin 42*a* as the rotational axis. At the position indicated by a solid line in FIG. 1, it guides the paper downward using its right hand surface (when in sort mode). In this mode, the paper is conveyed by a pair of conveyor rollers 45 and ejected into sorting bins $\mathbf{31}_1$ through $\mathbf{31}_{20}$ by a pair of ejection rollers 46. On the other hand, switching claw 42 slightly rotates clockwise in non-sort mode and guides the paper towards the left using its upper surface. In this mode, the paper is ejected into non-sorting bin 20 by a pair of ejection rollers 43.

Figure 4:
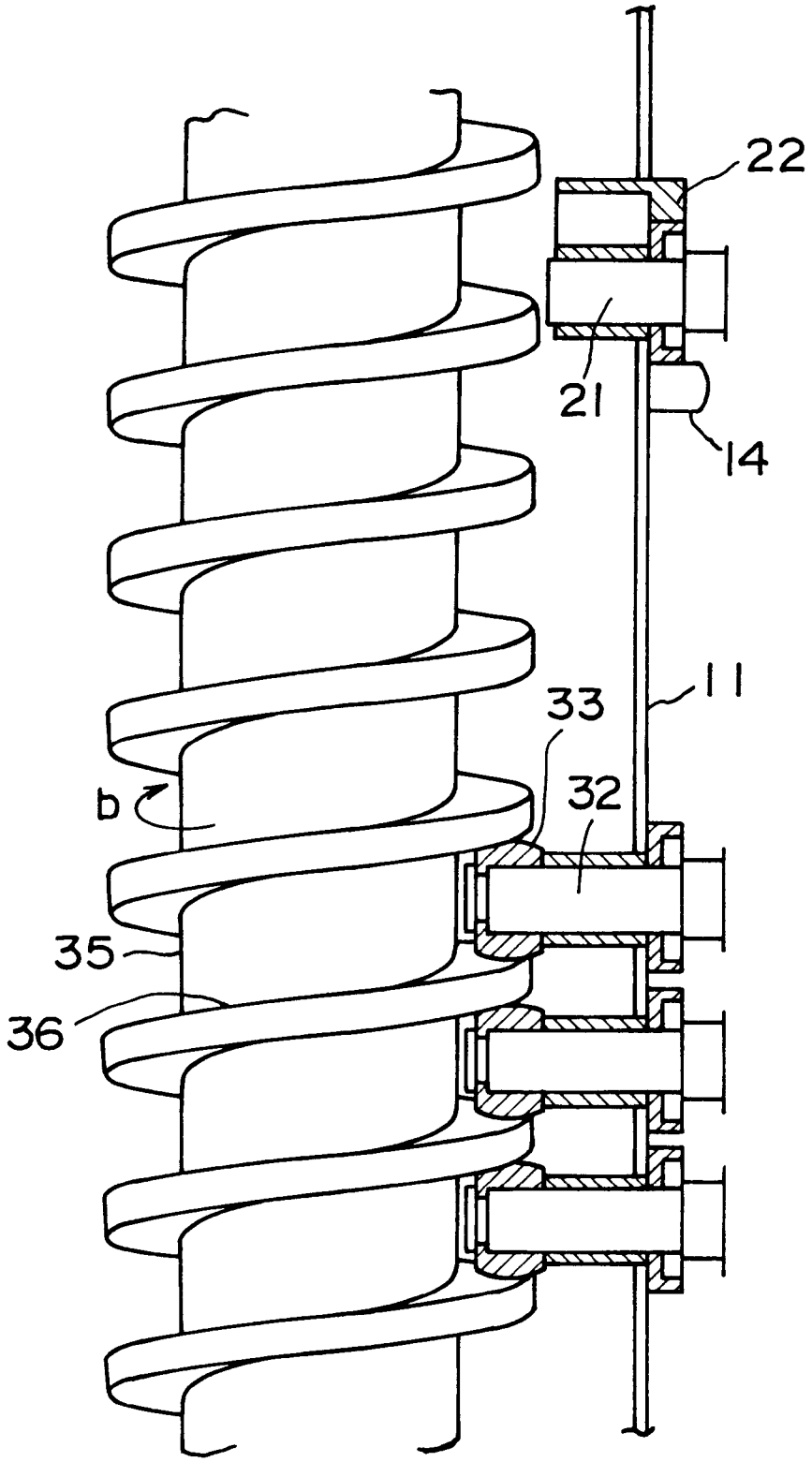
FIG. 4 is a plane view showing the engagement between the drive shaft and the sorting bins.

Bin assembly 30 comprises 20 sorting bins $\mathbf{31}_1$ through $\mathbf{31}_{20}$. Bins 31 are located such that they are angled and have a certain distance between them, and rollers 33 rotatably located at the tips of pins 32 that protrude from either side of each bin 31 in the front area are engaged with spiral groove 36 formed on the outer surface of drive shaft 35, as shown in FIG. 4. By rotating this drive shaft 35 forward or backward by a motor not shown in the drawing, sorting bins 31 are moved up or down in accordance with the pitch of the spiral due to the rotation of drive shaft 35.

The position indicated by a solid line in FIG. 1 is the lower limit standby position for bin assembly 30. In this position, first sorting bin $\mathbf{31}_1$ faces pair of ejection rollers 46. The position at which said sorting bin $\mathbf{31}_1$ faces pair of ejection rollers 46 is hereinafter called sort ejection level X1. The pitch of spiral groove 36 of drive shaft 35 one step above said level X1 is twice that of the rest of the spiral so that the distance between the sorting bin at level X1 and the sorting bin immediately above it will be larger and the ejection of paper from pair of rollers 46 will not be hindered (see the distance between sorting bins $\mathbf{31}_{12}$ and $\mathbf{31}_{13}$ in FIG. 2).

Sorting bins 31 are maintained at a certain angle by pins 32 engaged with guide groove 12 of sorter frame 11 and pins 34 protruding from either side of sorting bin 31 in the rear area and engaged with guide groove 13.

Non-sorting bin 20 is located such that it is angled by the same degree as sorting bins 31 by the engagement of pins 21 and 23 that protrude from either side on non-sorting bin 20 in the front and rear areas with guide grooves 12 and 13, respectively. It may also be freely moved up or down. This non-sorting bin 20 is not engaged with spiral groove 36 of drive shaft 35 and may be moved up or down independently of the rotation of drive shaft 35. It is set at level X2 at which it faces pair of ejection rollers 43 by bracket 22 attached to pin 21 coming into contact with stopper pin 14 that protrudes from sorter frame 11 (see FIG. 4). In other words, non-sort level X2 is the lower limit standby position for non-sorting bin 20, and non-sorting bin 20 may move up or down freely in a range above this standby position. When bin assembly 30 moves up after 13th sorting bin $\mathbf{31}_{13}$ is set at sort level X1 (see FIGS. 2 and 3), non-sorting bin 20 is pushed up by first bin $\mathbf{31}_1$.

The operation of sorter 10 will now be explained.

First, the initial state of sorter 10 is as shown in FIG. 1. Non-sorting bin 20 is standing by at non-sort level X2 by stopper pin 14. Bin assembly 30 is standing by with first sorting bin $\mathbf{31}_1$ set at sort level X1.

In non-sort mode, switching claw 42 is set at a position achieved by rotating it slightly clockwise from the solid line position in FIG. 1, and the paper on which an image is formed by the copying machine not shown in the drawing is sent into sorter 10 from direction indicated by arrow a. This paper is ejected into non-sorting tray 20 via pair of receiving rollers 41 through pair of ejection rollers 43.

In sort mode, switching claw 42 is set at the solid line position in FIG. 1, and the first sheet of paper is ejected into first sorting bin $\mathbf{31}_1$ via pair of receiving rollers 41 through pair of conveyor rollers 45 and pair of ejection rollers 46. When drive shaft 35 rotates in direction indicated by arrow b after ejection, bin assembly 30 moves up by as much as one thread of spiral groove 36 and second sorting bin $\mathbf{31}_2$ comes to be set at sort level X1 such that the second sheet of paper may be ejected into second sorting bin $\mathbf{31}_2$. Bin assembly 30 thereafter moves one thread at a time in the same manner each time paper is ejected. For paper on which an image from an even-numbered original is formed, bin assembly 30 moves down successively by one thread to receive the ejected paper.

Figure 2:
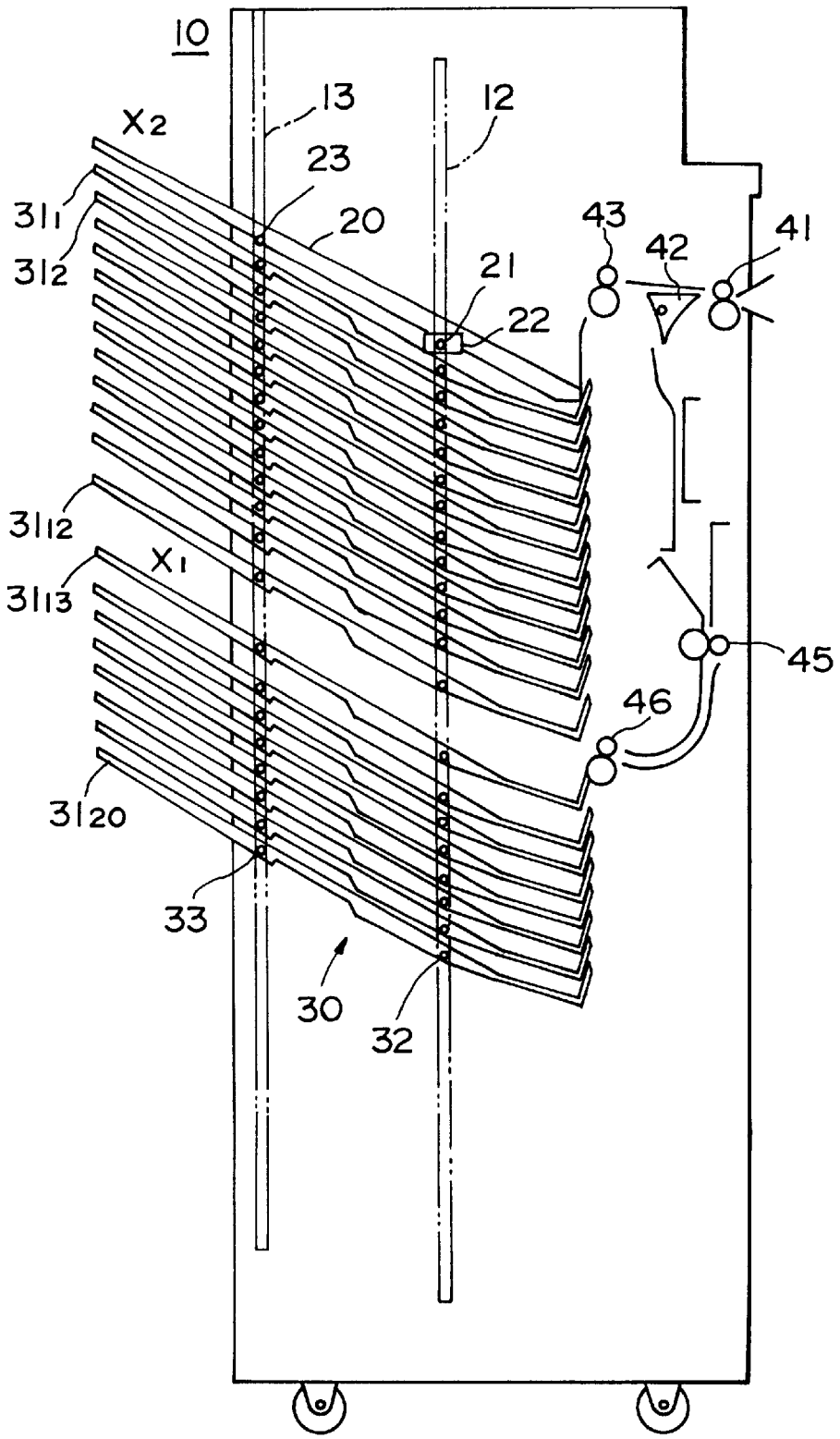
FIG. 2 is a plane view showing a situation in which the 13th sorting bin is set at sort level X1 in said sorter.
Figure 3:
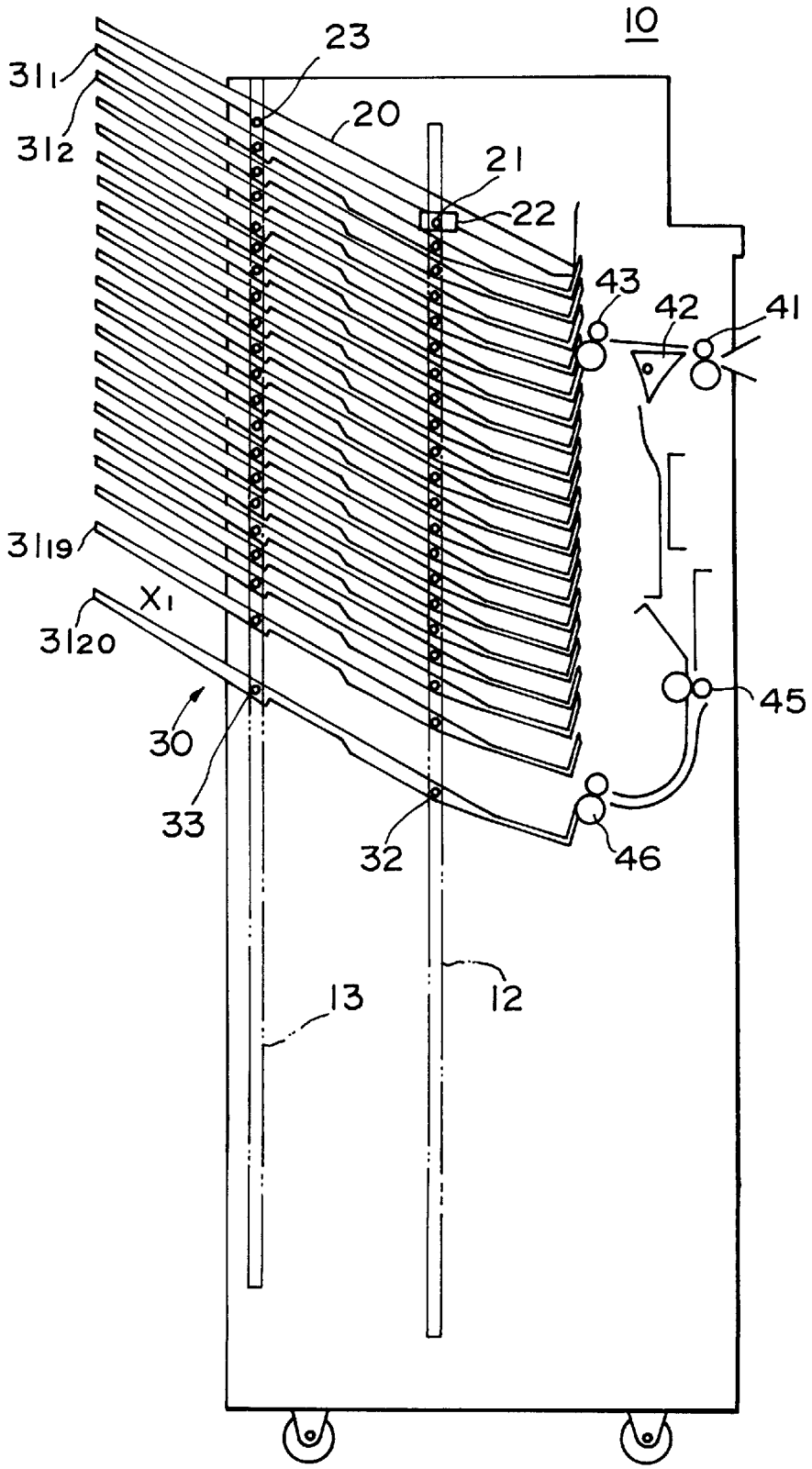
FIG. 3 is a plane view showing a situation in which the non-sorting bin and sorting bins have been moved up to the upper limit positions in said sorter.

Incidentally, in this embodiment, when 13th sorting bin $\mathbf{31}_{13}$ is set at sort level X1, as shown in FIG. 2, first sorting bin $\mathbf{31}_1$ comes into contact with bracket 22 of non-sorting bin 20. Therefore, when 13th sorting bin $\mathbf{31}_{13}$ moves up or down in a range above sort level X1, non-sorting bin 20 also moves together with 13th sorting bin $\mathbf{31}_{13}$. FIG. 3 shows a situation in which the lowest sorting bin $\mathbf{31}_{20}$ is set at sort level X1. This is the state in which bin assembly 30 and non-sorting bin 20 are at their upper limit positions. Where the number of copies is 13 or less, non-sorting bin 20 does not move.

In other words, in this embodiment, non-sorting bin 20 stands by at non-sort level X2 and bin assembly 30 stands by with first sorting bin $\mathbf{31}_1$ at sort level X1, as a result of which the paper may be immediately ejected to non-sorting bin 20 or first sorting bin $\mathbf{31}_1$ regardless of whether the copying machine is in non-sort mode or sort mode, and the entire copying process may be accelerated. In addition, because non-sorting bin 20 moves up or down together with bin assembly 30 when sorting bin $\mathbf{31}_{13}$ is above sort level X1, a space equivalent to the height of the area needed to install seven sorting bins becomes available. Naturally, the sorting bin regarding which non-sorting bin 20 begins to move with bin assembly 30 when said sorting bin is at sort level X1 may be determined by design.

The sorter pertaining to the present invention is not limited to the embodiment described above. It may be implemented in various other forms within its essential scope.

For example, any type of support mechanism or drive mechanism for the non-sorting bin and sorting bins and the paper conveyance mechanism used with the sorter may be used. The sorter may also be equipped with a mechanism for the implementation of finishing processes such as stapling and punching of holes.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sorter comprising:

a non-sorting exit from which an image medium is ejected in a non-sort mode;

a sorting exit from which an image medium is ejected in a sort mode;

a drive mechanism;

a non-sorting bin that receives an image medium ejected from said non-sorting exit when said non-sorting bin is positioned at a standby position; and a bin assembly, operatively engaging said drive mechanism, comprising a plurality of sorting bins that receive an image medium ejected from said sorting exit, wherein said plurality of sorting bins includes a first group having a plurality of sorting bins, said first group including a sorting bin which is capable of imparting movement to said non-sorting bin, and a second group having at least one sorting bin, where said first group does not include a sorting bin of said second group, wherein each sorting bin of said bin assembly is movable by said drive mechanism to a level for receiving an image medium from said sorting exit, and wherein said non-sorting bin is freely moveable within a range originating at said standby position, and said non-sorting bin remains in said standby position until a sorting bin of said second group is moved to a level to receive an image medium from said sorting exit.

2. The sorter as claimed in claim 1, wherein said drive mechanism includes a drive shaft having a spiral groove around its outer surface for imparting movement to each sorting bin of said bin assembly, wherein each sorting bin of said bin assembly has a pin which engages said spiral groove of said drive shaft.

3. The sorter as claimed in claim 2, further comprising a guide groove which further guides said pins of said sorting bins of said bin assembly.

4. The sorter as claimed in claim 3, wherein said drive mechanism includes a drive shaft having a spiral groove around its outer surface for imparting vertical movement to each sorting bin of said bin assembly, wherein each sorting bin of said bin assembly has a pin which engages said spiral groove of said drive shaft.

5. The sorter as claimed in claim 4, further comprising a guide groove which further guides said pins of said sorting bins of said bin assembly.

6. The sorter as claimed in claim 2, wherein said pin of said non-sorting bin does not engage said spiral groove of said drive shaft.

7. The sorter as claimed in claim 4, wherein said pin of said non-sorting bin does not engage said spiral groove of said drive shaft.

8. A sorter comprising:

a non-sorting exit from which an image medium is ejected in a non-sort mode when said non-sorting bin is positioned at a standby position;

a sorting exit, located below said non-sorting exit, from which an image medium is ejected in a sort mode;

a drive mechanism;

a non-sorting bin that receives an image medium ejected from said non-sorting exit, said non-sorting bin being vertically movable in a range above said standby position; and a bin assembly, operatively engaging said drive mechanism, having a plurality of sorting bins which receive image media ejected from said sorting exit, each of said sorting bins being vertically movable to a level corresponding to the sorting exit, wherein said plurality of sorting bins includes a first group having a plurality of sorting bins and a second group having at least one sorting bin, wherein said non-sorting bin is moved together with the bin assembly when a sorting bin of said second group is moved to a level corresponding to said sorting exit, and said non-sorting bin is maintained at said standby position when an image medium is ejected to any of said plurality of sorting bins of said first group of said bin assembly.

9. A sorting method used in a sorter for sorting image media having a plurality of media bins, including a non-sorting bin and a bin assembly having a plurality of sorting bins, said plurality of sorting bins including a first group having a plurality of sorting bins and a second group having at least one sorting bin, wherein in a standby position, said non-sorting bin faces a non-sorting medium exit and a first sorting bin of said bin assembly faces a sorting medium exit, said sorting method comprising steps of:

when a non-sorting mode is selected, ejecting media from the non-sorting medium exit to said non-sorting bin positioned at the standby position;

when a sorting mode is selected, ejecting a medium from the sorting medium exit to a sorter bin facing the sorting paper exit;

shifting the bin assembly to locate a next sorting bin of said bin assembly to a position where the next sorting bin faces the sorting medium exit; and repeating the ejecting and the shifting steps for respectively receiving and sorting media; and wherein the non-sorting bin is maintained at the standby position during said shifting step when media are ejected to the first group of the bin assembly, and the non-sorting bin is shifted together with the bin assembly during said shifting step when media are ejected to the second group of the bin assembly.

* * * * *